United States Patent [19]

Gomez Acevedo

[11] Patent Number: 5,048,728

[45] Date of Patent: Sep. 17, 1991

[54] ORAL LIQUIDS DISPENSER

[76] Inventor: Hector H. Gomez Acevedo, Rancho Jigüingo #25, Prado Coapa, Mexico City, Mexico, 14350

[21] Appl. No.: 412,911

[22] Filed: Sep. 26, 1989

[51] Int. Cl.[5] ..... A61J 7/00

[52] U.S. Cl. ..... 222/215; 222/546; 222/563; 215/DIG. 7; 141/138; 604/77

[58] Field of Search ..... 222/545, 546, 562, 563, 222/105, 106, 109, 111, 108, 192, 206, 215, 541; 220/257, 258; 215/DIG. 7, DIG. 3, 228, 276, 277, 247, 228, 307, 309, 341, 344, 354, 329; 141/381; 604/73, 76–79

[56] References Cited

U.S. PATENT DOCUMENTS

| | | | |
|---|---|---|---|
| 258,035 | 5/1882 | Eastman | 141/381 |
| 1,047,681 | 12/1912 | Moffat | 141/381 |
| 1,780,875 | 11/1930 | Gordon | 141/381 |
| 1,869,712 | 8/1932 | Palmer | 141/381 |
| 2,108,692 | 2/1938 | Pleck | 141/381 |
| 2,559,168 | 7/1957 | Numbers | 141/381 |
| 2,802,605 | 8/1957 | Parker | 222/215 |
| 2,808,167 | 10/1957 | Polazzolo | 215/DIG. 7 X |
| 3,854,478 | 12/1974 | Cunningham | 604/77 |
| 4,566,509 | 1/1986 | Szaina | 141/381 |
| 4,650,096 | 3/1987 | Thatcher | 222/541 X |
| 4,741,459 | 5/1988 | Silvenis et al. | 141/381 X |
| 4,798,313 | 1/1989 | Farley | 222/215 X |
| 4,804,096 | 2/1989 | Harding | 215/228 |

*Primary Examiner*—Michael S. Huppert
*Assistant Examiner*—Kenneth DeRosa
*Attorney, Agent, or Firm*—Helfgott & Karas

[57] ABSTRACT

A dispenser for dispensing of liquids to the oral cavity of an individual or animal comprises a tubular body having two ends, with one of the ends being a frusto-conical end provided with an orifice at the tip thereof to serve as an injector for overcoming resistance to swallowing, and the other of the ends being an angularly chamfered open end which is used as a gravity dispenser. The tubular body is axially inserted in a cap suitable for capping a flask and containing a complementary tubular wall to axially receive the tubular body of the dispenser, whereby, when the frusto-conical end of the tubular body is inserted within the cap, the chamfered open end of the tubular body becomes free to dispense a liquid contained therein by gravity, whereas when the chamfered open end of the tubular body is inserted within the cap, the frusto-conical end becomes free and serves as an injector to forcibly dispense the liquid by squeezing the tubular body. The tubular body may also be inserted outwardly of the cap, with the cap suitably bored and with the frusto-conical end being a dispensing end so as to enable the injection of the liquid by squeezing the flask.

9 Claims, 2 Drawing Sheets

ORAL LIQUIDS DISPENSER

BACKGROUND OF THE INVENTION

The present invention relates to oral liquids dispensers and more particularly to an oral liquids dispenser for animals and humans, particularly for animals or humans showing reluctance to oral liquids supply, because it allows the liquid supply both to animals and humans in a very efficient way, even against their will.

A variety of liquids dispensing devices, such as spoons, droppers, probes, straws, glasses are known in the prior art, but all of them are useful only when individuals who are going to be supplied with liquids do not offer resistance to the supplying thereof, and definitely, those conventional devices are not suitable to animals since, particularly with straws, the liquid has to be sucked, and also, the use of such devices requires the full will of the receiver.

With respect to the probes, these are hardly accepted by the receivers of the liquids because of the nuisances caused thereby, and with respect to the droppers, when the liquid is supplied by force it is usually rejected by the receiver since it can cause a cough reaction by the force employed to introduce it into the mouth.

With respect to the spoons and glasses, it is definitely difficult for animals to use them, and as abovesaid, humans must be willing to drink the liquid in order for them to use said devices.

SUMMARY OF THE INVENTION

It is an object of the present invention to provide an oral liquids dispenser by which the liquid supplying can be carried out efficiently, even against the will of the subject to which the liquids are being administered.

It is another object of the present invention to provide an oral liquid dispenser, which shows a great versatility of applications.

It is yet a further object of the present invention to provide an oral liquid dispenser of the foregoing type which can be connected to a larger container in order to provide a higher dose of liquids.

The oral liquids dispenser of the present invention comprises an externally or internally threaded cap, so as to respectively fit to internally or externally threaded flasks, the cap being provided with a tubular wall which may be the cap inner wall itself, or may be separated from the cap inner wall, depending on the type of flask to be used. The liquid dispenser of this invention further comprises an elongated cylindrical body, which can be inserted into the tubular wall, the elongated cylindrical body being positioned inside the flask and having one end obliquely chamfered, with the tip thereof cut very close to the end so as to have round edges. The other end of the elongated cylindrical body is a truncated conical-shaped, and is provided with a through orifice on the truncated portion of the cone, which may be covered with a rupturable membrane placed on the orifice. Close to each end, the elongated tubular body may be provided with an external thread allowing to threadely insert the elongated cylindrical body into the hollow wall integral to the flask cap. The elongated cylindrical body may be provided with threads only on one end thereof or with no threads at all, and in the last case, the cylindrical body may be fixed in the tubular wall by pressure or friction, or it may be fixed with an adhesive inside the inner tubular wall devoided of threads. The flask cap is provided centrally of and within the tubular wall with a projection which, in absence of the membrane on the orifice located on the conical end of the elongated cylindrical body, obstructs the orifice, thus preventing liquids leakage.

The liquid dispenser of the present invention is useful in supplying liquids orally to humans and animals, particularly those showing reluctance to oral liquids supply.

The aforementioned objects, features and advantages of the invention will, in part, be pointed out with particularity, and will, in part, become obvious from the following more detailed description of the invention, taken in conjunction with the accompanying drawing, which form an integral part thereof.

DETAILED DESCRIPTION OF THE PREFERRED EMBODIMENTS

Figure 1:
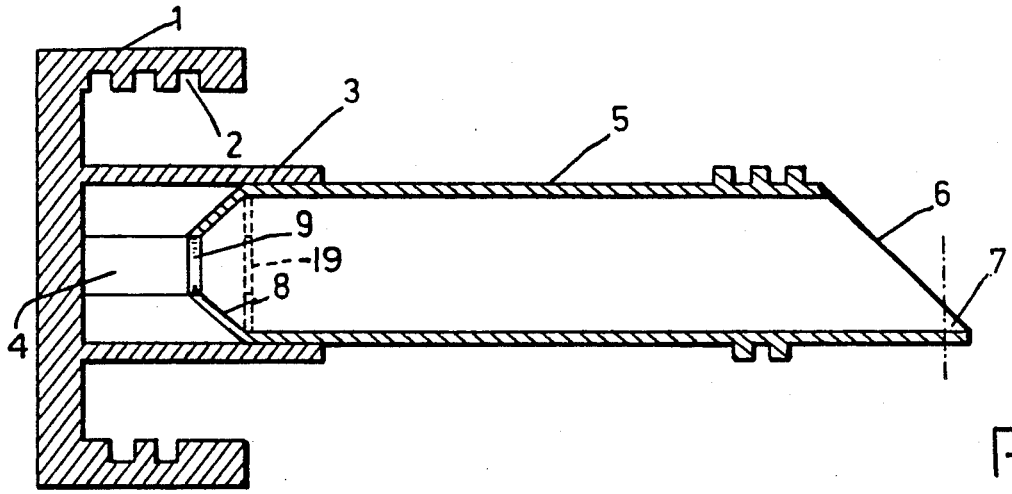
FIG. 1 is a cross-sectional view of the oral liquids dispenser of the present invention, show a first embodiment thereof.

Referring now to the drawings, and more particularly to FIG. 1 thereof, there is shown an embodiment of the oral liquids dispenser of the present invention, which comprises a flaskcap 1 provided in this particular case with internal threads 2 in order for the cap to be placed on a flask (not shown) which is provided with external threads. Cap 1 is also provided with an inner tubular wall 3, preferably integral and centered thereto, and which in the particular case of FIG. 1 of the drawings has smooth inner walls. Within the cylindrical surface of hollow wall 3, on the inner wall of the cap 1, there is provided a cylindrical plugging projection 4, whose function will be hereinafter described. The oral liquids dispense further having an elongated tubular body 5 comprising a slant cut or chamfered end 6 having its tip transversely cut at 7 so as to eliminate the sharp edges of the slant cut or chamfer. The other end of the elongated tubular body 5, referenced with number 8, is of frusto-conical shape, having at the truncated portion of the cone an orifice 9 which in the particular embodiment shown in FIG. 1 of the drawings in plugged by plugging projection 4, when the elongated tubular body 5 is introduced into the tubular wall 3, the elongated tubular body 5 being firmly fastened to the inner surface of the tubular wall 3, either by pressure fitting or by means of an adhesive.

Figure 2:
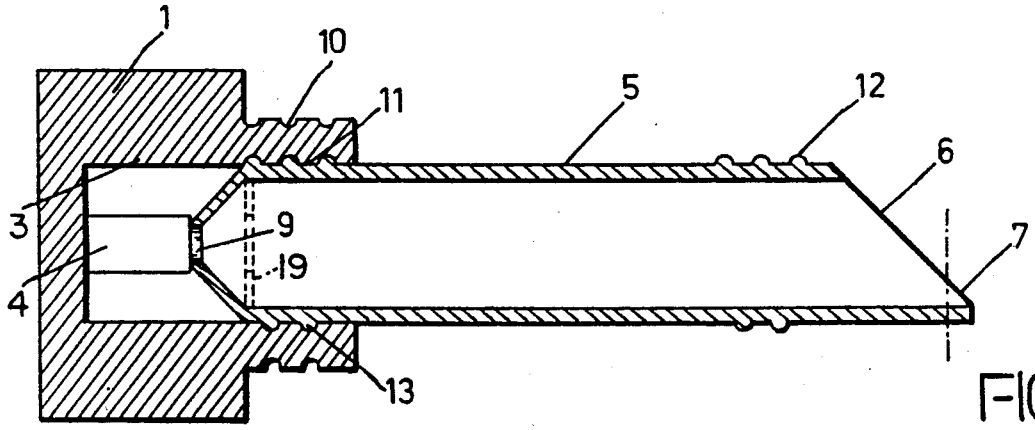
FIG. 2 is a cross-sectional view similar to FIG. 1, showing the device of a second embodiment of the invention.
Figure 3:
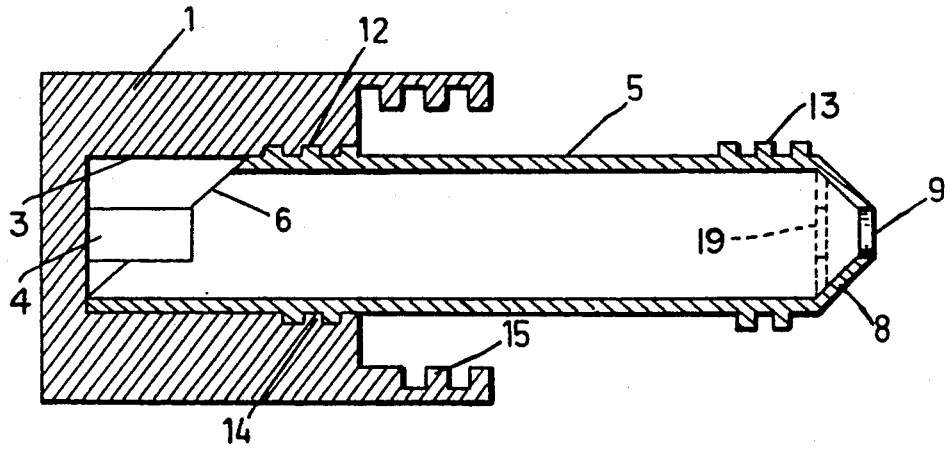
FIG. 3 is a cross-sectional view similar to the preceding figures, showing a third embodiment of the device in a different position and with an additional cap embodiment.

The cylindrical body 5 may also be inserted with its chamfered end within the tubular wall 3 in which case orifice 9 will be obstructed by a rupturable membrane 19 shown in FIGS. 1–3 with dotted lines.

Once the cylindrical body 5 has been placed as indicated hereinabove it will be respectively used as a spoon or as a dropper.

The cylindrical body 5 is made of a flexible, semi-rigid, transparent material, which are characteristics giving thereto a unique usefulness as will be hereinafter described.

Referring now to FIG. 2 of the drawings, there is shown a second embodiment of the oral liquids dispenser. The dispenser comprises a cap 1 provided in this case with external threads 10 and internal threads 11 within the tubular wall 3. The elongated tubular body 5 has external threads on each end thereof. A threaded portion 12 is close to the chamfered end and a threaded portion 13 is close to the frusto-conical end so that the elongated cylindrical body 5 may be threadedly fastened in the cylindrical wall 3 of the flask cap 1, by either end. It FIG. 3 it is shown inserted by its chamfered end.

The orifice 9 on the frusto-conical end of the elongated cylindrical body 5 may be of different sizes depending on the dose to be administered.

In the embodiment of FIG. 3, the elongated cylindrical body 5 is threadedly introduced into the cylindrical wall 3 of cap 1 in such a way that it is fastened by means of the external threads 12 of the body coupled with the internal threads 14 of the cap 1. As is seen from FIGS. 1 and 2, the elongated cylindrical body 5 may be used together with caps provided with internal threads such as threads 2 and 15 or external threads such as threads 10, depending on the type of flask to be used, i.e. an internally or externally threaded flask.

Figure 5:
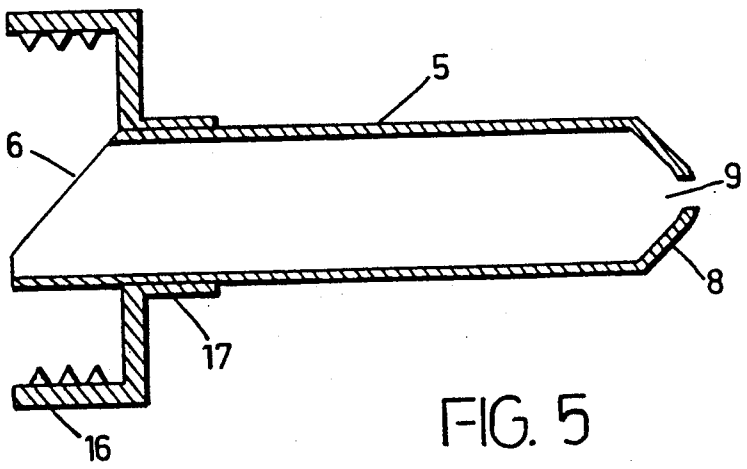
FIG. 5 is a cross-sectional view showing a fifth embodiment of the device of the invention.
Figure 4:
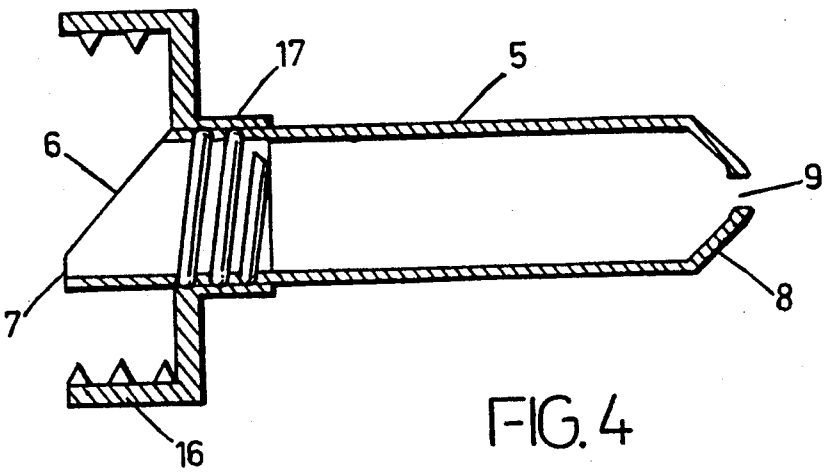
FIG. 4 is a cross-sectional view showing a fourth embodiment of the liquids dispenser of the present invention.

As is shown in FIG. 4, the elongated cylindrical body 5 is placed in a different cap 16, useful to be applied in larger flasks; cap 16 comprising an externally extending tubular wall 17, centered in the cap, in place of the tubular wall 3 internally located in the cap 1 of the previously described embodiments. Cap 16 is centrally bored as shown at 18, so that the end portion of body 5 extends through the cap. The elongated cylindrical body 5 can be fixed inside the tubular wall 17, by either end, either by means of threads as shown in FIG. 4 or otherwise as above indicated and as shown in FIG. 5.

The oral liquid dispenser of the present invention may be used in several ways and is preferably used by filling the cylindrical body 5 with a liquid through the chamfered end 6, while keeping the other end 9 closed and the elongated cylindrical body 5 inclined at an angle of about 45° in order for it to expose the largest possible surface to the incoming liquid, because in this way the cut end will be kept with the cut in the horizontal position. The cylindrical body 5 is filled up to the desired dose controlled by a column mark, and this operation can be watched through the cylindrical body wall due to its transparency, and then it is proceeded to pour the contents of the elongated cylindrical body 5 into the individual mouth cavity, with the advantage that the individual does not need to raise in a case he is in a horizontal position and in case he shows a moderate reluctance to swallowing. The cylindrical shape and the chamfered end of the body 5 will allow the introduction of the cylindrical body through the lips and locate it in the space between the outer or front portion of the teeth and the inner or back wall of the lips, and from there, the liquid will pass through the teeth into the mouth cavity.

An additional use of the oral liquids dispenser of the present invention applies when the individual shows high reluctance to swallowing the liquid, because then the elongated cylindrical body 5 will be separated from the cap 1, the rupturable membrane will be ruptured and the cylindrical body 5 will be filled with the liquid while the orifice 9 is obstructed, and then the elongated cylindrical body 5 will be forcedly introduced into the mouth of the individual allowing the liquid to flow simply by gravity or by alternately pressing with a finger on the larger and opposite aperture formed in the chamfered end, thus exerting a pumping action effective enough to introduce by force the liquid into the mouth.

When the reluctance shown by the individual receiving the liquid is extreme, then, once the elongated cylindrical body 5 has been filled with the liquid to be administered, it is again introduced into the cap 1 by its chamfered end 6, so that it will be tightly closed at this end so that the only outlet is now through the orifice 9 of the conical portion 8, from where the membrane is has been ruptured, and the elongated cylindrical body 5 is then introduced into the perioral cavity and the cylindrical body walls are alternately squeezed with the fingers, thus forcing the liquid to flow at a higher rate. In this case, if the elongated cylindrical body 5 is positioned by force between the upper and lower molar teeth the receiver himself, when he tries to close his jaws, will produce the squeezing effect over the walls of the cylindrical body, resulting in the pumping of liquid through the aperture and into the oral cavity.

On the other hand, when it is necessary to supply higher volumes of liquid wherein the accuracy in the supplied dose is not the more relevant fact, for instance in dehydrated children who are too weak to suck liquids from a normal nursing bottle, but whose oral rehydration is still advisable, the elongated cylindrical body 5 is then screwed, by the chamfered end, into a cap 16, such as the one shown in FIGS. 4 and 5 of the drawings, provided with a cylindrical and hollow portion 17 centrally and externally located thereon, and said cap 16 will be connected to a larger container (not shown), preferably made of elastic and semi-rigid material, in such a way that when the conical end 8 of the elongated cylindrical body 5 is introduced into the oral or perioral cavity and it is gently squeezed, the individual is forced to swallow the liquid.

As it can be seen from the different figures of the drawings, and as has been described above, the elongated cylindrical body 5 of the oral liquids dispenser of the present invention can be used at only one end thereof, and for that purpose the body may be made integral with the cap or it may be glued to the cap, to make it possible to place the elongated cylindrical body 5, either with its chamfered end 6 outside or with its conical end 8 outside.

The elongated cylindrical body 5 may also be employed with a variety of caps, according to the type of flask to be used, that is, flasks having external or internal threads, the caps being then respectively internally or externally threaded, or the cap may be as disclosed in the last embodiment shown in FIGS. 4 and 5 of the drawings, provided with a dimension suitable to be used with a larger flask and provided with a cylindrical and hollow projection external to the cap, said cap being centrally bored in order to allow the external cylindrical portion to extend through the cap, into the flask.

The cone and chamfer forming angles may vary according to the intended use of the oral liquids dispenser of the invention. The elasticity, the hardness, the stiffness, and the transparency of the material may also be varied. The elongated cylindrical body may have threads at both ends or no threads at all, both ends thereof may be of the same shape, or the original chamfer may be replaced with closed or opened transversal cuts or the conical portion may be replaced with a closed chamfer provided with a small orifice and provided with a rupturable membrane.

Although there has been described preferred embodiments of the invention, with illustrative purposes, those skilled in the art will realize that there are possible many additions, modifications and substitutions without departing from the scope and spirit of the invention as defined in the appended claims.

I claim:

1. An oral liquid dispenser comprising an elongated tubular body which can be filled with a liquid and has two ends, one of said ends being of a frusto-conical shape and having an orifice at a tip thereof and another of said ends being a diagonally cut open end; insertably removable means for obstructing said orifice at said tip of said frusto-conical end; and a cap adapted to be attached to a neck of a receptacle containing the liquid, said cap having a tubular wall portion perpendicularly extended and centrally positioned thereto, said tubular wall portion having means for engaging said tubular body so that said tubular body is axially inserted in said tubular wall portion with one of its two ends extending within said tubular wall portion and the other of its ends extending outwardly of said tubular wall portion, whereby said other end outwardly extending of said tubular wall portion constitutes a liquid dispensing end, wherein said tubular wall portion of said cap extends inwardly of said cap, said tubular body being inserted into said tubular wall portion with said frusto-conical end extending within said tubular wall and said diagonally cut open end extending outwardly of said tubular wall portion, said cap having an axial central extension for plugging said orifice at said tip of said frusto-conical end of said tubular body, and said diagonally cut open end of said tubular body being the dispensing end for supplying said liquid by gravity into the mouth of the user of the dispenser, upon removal of said cap from said receptacle and filling of said tubular body with said liquid.

2. A dispenser as claimed in claim 1, wherein said removable means for obstructing said orifice at said tip of the frusto-conical end of said tubular body comprises a plug insertable in said orifice.

3. A dispenser as claimed in claim 2, wherein said plug is an axial extension of said cap, said extension projecting centrally of said tubular wall portion of said cap so that, when said tubular body is introduced into said tubular wall portion, said extension will plug said orifice.

4. A dispenser as claimed in claim 1, wherein said removable means for obstructing said orifice at said tip of the frusto-conical end of said tubular body comprises a rupturable membrane positioned near said frusto-conical end of said tubular body.

5. A dispenser as claimed in claim 1, wherein said means for engaging said tubular body to said tubular wall portion of said cap comprise complementary threads provided on said tubular body and is said tubular wall portion.

6. A dispenser as claimed in claim 1, wherein said tubular body is press-fitted in said tubular wall portion.

7. A dispenser as claimed in claim 6, wherein an adhesive is applied between said tubular wall portion and said tubular body.

8. An oral liquid dispenser comprising an elongated tubular body which can be filled with a liquid and has two ends, one of said ends being of a frusto-conical shape and having an orifice at a tip thereof and another of said ends being a diagonally cut open end; insertably removable means for obstructing said orifice at said tip of said frusto-conical end; and a cap adapted to be attached to a neck of a receptacle containing the liquid, said cap having a tubular wall portion perpendicularly extended and centrally positioned thereto, said tubular wall portion having means for engaging said tubular wall so that said tubular body is axially inserted in said tubular wall portion with one of its two ends extending within said tubular wall portion and the other of its ends extending outwardly of said tubular wall portion, whereby said other end outwardly extending of said tubular wall portion constitutes a liquid dispensing end, wherein said tubular wall portion of said cap extends outwardly of said cap in a direction opposite to the neck of said receptacle when said cap is attached to the neck of the receptacle, said tubular body being inserted into said tubular wall portion with said diagonally cut open end extending within said tubular wall portion and said frusto-conical end extending outwardly of said tubular wall portion, said cap having a through bore coincident with said tubular wall portion whereby said frusto-conical end of said tubular body constitutes the dispensing end of the dispenser, said dispenser when attached to the receptacle being capable of forcibly dispensing a liquid contained in said receptacle, upon removal of said removable obstructing means, through the frusto-conical end of said tubular body, by squeezing said receptacle.

9. A dispenser as claimed in claim 8, wherein said tubular body is integrally formed with said tubular wall portion of said cap.

* * * * *